US007006920B2

(12) United States Patent
Newman et al.

(10) Patent No.: US 7,006,920 B2
(45) Date of Patent: Feb. 28, 2006

(54) ACTIVITY DATA CAPTURE SYSTEM FOR A WELL SERVICE VEHICLE

(75) Inventors: Frederic M. Newman, Midland, TX (US); Paul Herring, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 0 days.

(21) Appl. No.: 10/957,309

(22) Filed: Oct. 1, 2004

(65) Prior Publication Data

US 2005/0103491 A1 May 19, 2005

Related U.S. Application Data

(60) Provisional application No. 60/508,730, filed on Oct. 3, 2003.

(51) Int. Cl.
*G01V 9/00* (2006.01)

(52) U.S. Cl. ..... 702/6

(58) Field of Classification Search ..... 702/6, 702/14, 16, 7, 8, 9, 10; 367/69, 76
See application file for complete search history.

(56) References Cited

U.S. PATENT DOCUMENTS

| | | | | |
|---|---|---|---|---|
| 4,794,534 A | | 12/1988 | Millheim | 364/420 |
| 5,278,549 A | | 1/1994 | Crawford | 340/853.2 |
| 5,648,901 A | * | 7/1997 | Gudat et al. | 701/23 |
| 5,839,317 A | | 11/1998 | Rosenfield | 73/784 |
| 5,987,125 A | * | 11/1999 | Stringer et al. | 713/150 |
| 6,012,016 A | * | 1/2000 | Bilden et al. | 702/12 |
| 6,023,223 A | * | 2/2000 | Baxter, Jr. | 340/531 |
| 6,037,901 A | * | 3/2000 | Devier et al. | 342/357.17 |
| 6,079,490 A | | 6/2000 | Newman | 166/77.51 |
| 6,164,493 A | | 12/2000 | Shelton, Jr. | 222/1 |
| 6,168,054 B1 | | 1/2001 | Shelton, Jr. | 222/608 |
| 6,209,639 B1 | | 4/2001 | Newman | 166/250.01 |
| 6,212,763 B1 | | 4/2001 | Newman | 29/702 |
| 6,213,207 B1 | | 4/2001 | Newman | 166/250.01 |
| 6,241,020 B1 | | 6/2001 | Newman | 166/250.01 |
| 6,253,849 B1 | | 7/2001 | Newman | 166/255.1 |
| 6,276,449 B1 | | 8/2001 | Newman | 166/53 |
| 6,285,955 B1 | * | 9/2001 | Goldwasser | 702/6 |

(Continued)

OTHER PUBLICATIONS

Keenan, Patrick G., Exploration Logging Overseas, Inc., and Dyson, Peter M., Exploration Logging (Services) Ltd. SPE 9620. "Wellsite Computers—Their Increasing Role in Drilling Operations." (6 pages), 1981.

(Continued)

*Primary Examiner*—Donald McElheny, Jr.
(74) *Attorney, Agent, or Firm*—King & Spalding, LLP

(57) ABSTRACT

The present invention is directed to incrementing a well service rig in such a manner that activity-based and/or time-based data for the well site is recorded. The acquired data can be transmitted via wired, wireless, satellite or physical to a data center preferably controlled by the workover rig owner, but alternately controlled by the well owner or another. The data can thereafter be used to provide the customer a detailed invoice or a searchable, secure web-based database. With such information, the customer can schedule other services at the well site. Further, the customer will have access to detailed data on the actual service performed. The present invention fosters a synergistic relationship among the customer and the service companies that promotes a safe environment by monitoring crew work activities and equipment speeds; improving productivity; reducing operation expenses through improved job processes; and better data management and reduced operational failures.

62 Claims, 12 Drawing Sheets

U.S. PATENT DOCUMENTS

| | | | | |
|---|---|---|---|---|
| 6,374,706 | B1 | 4/2002 | Newman | 81/57.34 |
| 6,377,189 | B1 | 4/2002 | Newman | 340/854.6 |
| 6,429,812 | B1 * | 8/2002 | Hoffberg | 342/357.1 |
| 6,498,988 | B1 * | 12/2002 | Robert et al. | 702/6 |
| 6,519,568 | B1 * | 2/2003 | Harvey et al. | 705/1 |
| 6,546,363 | B1 * | 4/2003 | Hagenbuch | 703/7 |
| 6,560,565 | B1 * | 5/2003 | Roy et al. | 702/188 |
| 6,578,634 | B1 * | 6/2003 | Newman | 166/250.01 |
| 6,728,638 | B1 * | 4/2004 | Newman | 702/5 |
| 6,826,483 | B1 * | 11/2004 | Anderson et al. | 702/13 |
| 6,826,492 | B1 * | 11/2004 | Newman | 702/45 |
| 2002/0156582 | A1 | 10/2002 | Newman | 702/5 |
| 2002/0156591 | A1 | 10/2002 | Newman | 702/45 |
| 2002/0156670 | A1 | 10/2002 | Newman | 705/9 |
| 2002/0156730 | A1 | 10/2002 | Newman | 705/40 |
| 2003/0042020 | A1 | 3/2003 | Newman | 166/250.15 |

OTHER PUBLICATIONS

Graff, R.L., Tenneco Exploration & Production, and Varnado, S.G., NL Sperry Sun. SPE 14068. "Use of Data Center and Telecommunications in Drilling Operations and Engineering." (8 pages), 1986.

Veenkant, R. and Vitali, J.D., Amoco Production Co. SPE 14072. "Satellite Communications Change Drilling Operations." (9 pages), 1986.

Walbe, Kim A., Walbe & Associates, Inc. SPE 30985. "Satellites and the Oilpatch or, Resolving the Heclarewe Problem." (4 pages), 1995.

* cited by examiner

FILE EDIT VIEW FAVORITES TOOLS HELP ⇐BACK» ADDRESS LINKS»

ENTER DATE RANGE

DATES BETWEEN

AND

UPDATE

JOB SUMMARY

RIG #_____ : DATE: _____

_____ <ORGANIZATION UNIT
_____ <START TIME
_____ <END TIME
_____ <TOTAL EXCEPTIONS
_____ <TOTAL EVENTS

PLOT SENSORS: HOOK LOAD / TONG PRESSURE / ENGINE SPEED

ACTIVITIES

| ACTIVITIES | EXCEPTIONS | START | END | STATUS |
|---|---|---|---|---|
| GLOBAL: TRANSITION: START-UP | | 06/30/03 06:30 | 06/30/03 06:50 | ON TASK: ROUTINE |
| GLOBAL: OTHER: ROAD RIG | | 06/30/03 06:50 | 06/30/03 07:45 | ON TASK: ROUTINE |
| RIG-UP: SERVICE UNIT: MOVE IN | | 06/30/03 07:45 | 06/30/03 08:10 | ON TASK: ROUTINE |
| RIG-UP: SERVICE UNIT: RAISE/SCOPE | | 06/30/03 08:10 | 06/30/03 08:35 | ON TASK: ROUTINE |
| GLOBAL: TRANSITION: TUBING TO RODS | | 06/30/03 08:35 | 06/30/03 09:05 | ON TASK: ROUTINE |
| INTERNAL: RODS: UNSEAL PUMP | MECHANICAL FAILURE: (47 MIN) | 06/30/03 09:05 | 06/30/03 09:15 | ON TASK: EXTENDED |
| PULL RODS: PUMP | | 06/30/03 09:15 | 06/30/03 11:20 | ON TASK: ROUTINE |

INTERNET

*FIG. 11*

ACTIVITY DATA CAPTURE SYSTEM FOR A WELL SERVICE VEHICLE

This application claims priority from U.S. Provisional Patent Application No. 60/508,730, filed Oct. 3, 2003.

BACKGROUND OF THE INVENTION

1. Field of the Invention

The technical field of the present invention relates generally to acquisition of data concerning servicing hydrocarbon wells and more specifically to an instrumented, computerized work over rig adapted to record and transmit data concerning well servicing activities and conditions at a well site.

2. Description of the Related Art

After a well has been drilled, it must be completed before it can produce gas or oil. Once completed, a variety of events may occur to the formation, the well and its equipment that requires a "work-over." For purposes of this application, "work-over" and "service" operations are used in their very broadest sense to refer to any and all activities performed on or for a well to repair or rehabilitate the well, and also includes activities to shut in or cap the well. Generally, work over operations include such things as replacing worn or damaged parts (e.g., a pump, sucker rods, tubing, and packer glands), applying secondary or tertiary recovery techniques, such as chemical or hot oil treatments, cementing the well bore, and logging the well bore to name just a few. Service operations are usually performed by or involve a mobile work-over rig that is adapted to, among other things, pull the well tubing or rods and also to run the tubing or rods back in. Typically, these mobile service rigs are motor vehicle-based and have an extendible, jack-up derrick complete with draw works and block. In addition to the service or work-over rig, additional service companies and equipment may be involved to provide specialize operations. Examples of such specialized services includes: a chemical tanker, a cementing truck or trailer, a well logging truck, perforating truck, and a hot-oiler truck or trailer.

It is conventional for a well owner to contract with a service company to provide all or a portion of the necessary work-over operations. For example, a well owner, or customer, may contract with a work-over rig provider to pull the tubing from a specific well, contract with one or more service providers to provide other specific services in conjunction with the work-over rig company so that the well can be rehabilitated according to the owner's direction.

It is typical for the well owner to receive individual invoices for services rendered from each company that was involved in the work over. For example, if the portable work-over rig spent 30 hours at the well site, the customer well owner will be billed for 30 rig hours at the prevailing hourly rate. The customer is rarely provided any detail on this bill as to when the various other individual operations were started or completed, or how much material was used. Occasionally, the customer might be supplied with hand-written notes from the rig operator, but such is the exception, not the rule. Similarly, the customer will receive invoices from the other service companies that were involved with working over the well. The customer is often left with little to no indication of whether the service operation for which it is billed were done properly, and in some cases, even done at all. Further, most well owners own more than one well in a given field and the invoices from the various companies may confuse the well name with the services rendered. Also, if an accident or some other notable incident occurs at the well site during a service operation, it may be difficult to determine the root cause or who was involved because there is rarely any documentation of what actually went on at the well site. Of course, a well owner can have one of his agents at the well site to monitor the work-over operations and report back to the owner, but such "hands-on" reporting is often times prohibitively expensive.

The present invention is directed to ameliorating these and other problems associated with oil well work-over operations.

BRIEF SUMMARY OF THE INVENTION

The present invention is directed to incrementing a well service rig in such a manner that activity-based and/or time-based data for the well site is recorded. The invention contemplates that the acquired data can be transmitted in near real-time or periodically via wired, wireless, satellite or physical transfer such as by memory module to a data center preferably controlled by the work-over rig owner, but alternately controlled by the well owner or another. The data can thereafter be used to provide the customer in various forms ranging from a detailed invoice to a searchable, secure web-based database. With such information, the customer can schedule other services at the well site. Further, the customer will have access to detailed data on the actual service performed and can then verify invoices. The present invention fosters a synergistic relationship among the customer and the service companies that promotes a safe environment by monitoring crew work activities and equipment speeds; improving productivity; reducing operation expenses through improved job processes; and better data management and reduced operational failures.

BRIEF DESCRIPTION OF THE SEVERAL VIEWS OF THE DRAWINGS

FIG. 11 shows an exception-reporting page for a single well service operation for a customer.

DETAILED DESCRIPTION OF THE INVENTION

Figure 1A:
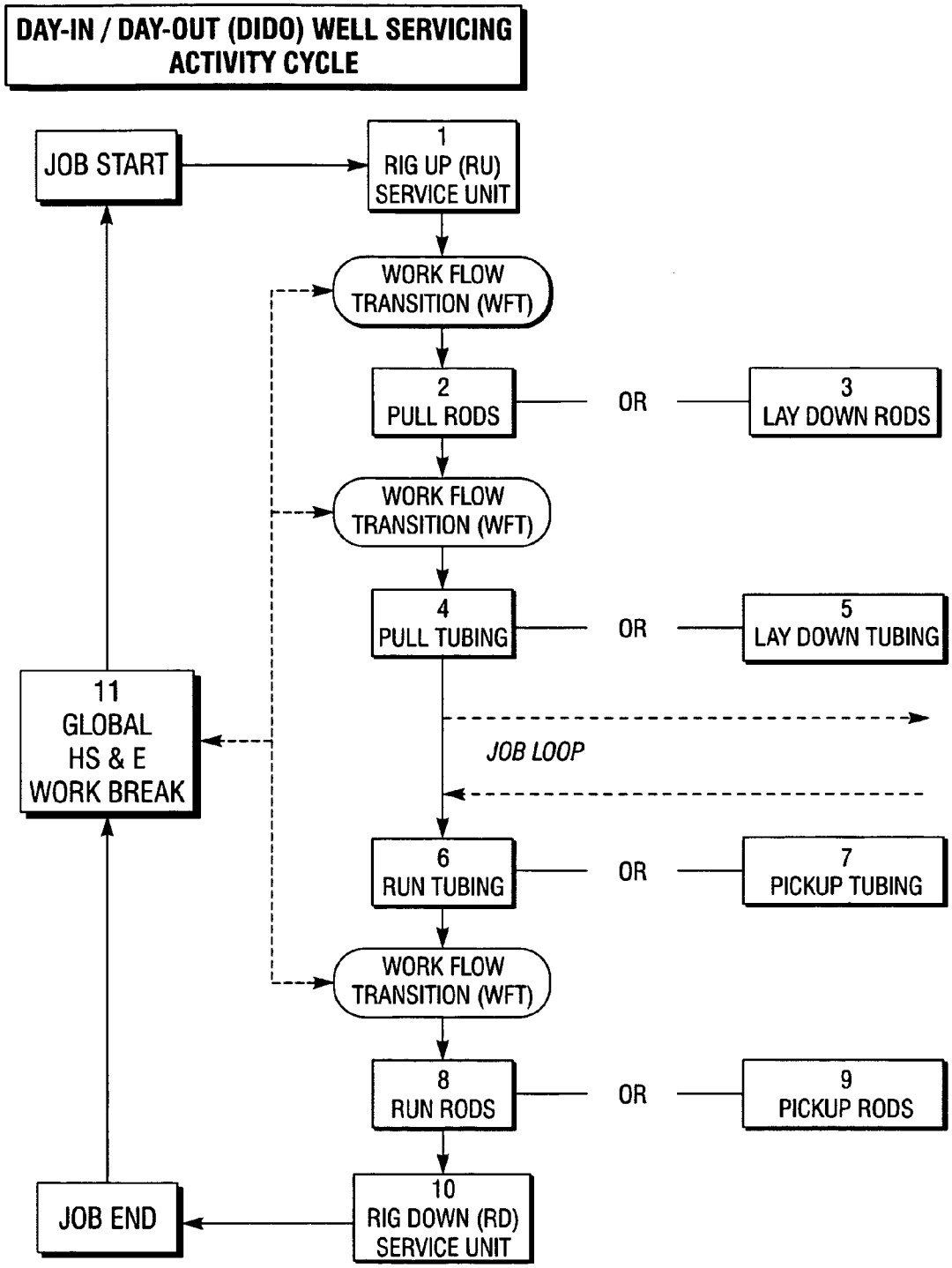
FIGS. 1A–B illustrate one example of a well servicing activity cycle.

Because the mobile work-over rig is typically the center of work-over or service operations at the well site, the present invention is directed to incrementing the service rig in such a manner that activity-based and/or time-based data for the well site is recorded. The invention contemplates that the acquired data can be transmitted in near real-time or periodically via wired, wireless, satellite or physical transfer such as by memory module to a data center preferably controlled by the work-over rig owner, but alternately controlled by the well owner or another. The data can thereafter be used to provide the customer in various forms ranging from a detailed invoice to a searchable, secure web-based database. This latter implementation of the invention permits a well-owner customer to monitor the progress, depending upon the update rate, of the work-over services being performed on the well. As described below in more detail, by accessing the data through a regularly updated web portal, the customer may be able to determine in near real time that, for example, the tubing pull will be completed in approximately 2 hours. With such information, the customer can schedule other services at the well site. Further, the customer will have access to detailed data on the actual service performed and can then verify its invoices.

The present invention fosters a synergistic relationship among the customer and the service companies that promotes a safe environment by monitoring crew work activities and equipment speeds; improving productivity; reducing operation expenses through improved job processes; and better data management and reduced operational failures.

Implementation of the invention on a conventional work-over rig can be conceptualized in two main aspects: 1) acquisition, recordation and transmission of transducer data such as hook load, hydraulic pressure, flow rate, etc. and 2) acquisition, recordation, and transmission of service-based activity, such as "Rig Up," "Nipple Up Blow Out Preventer," and "Pull Tubing," among others. Acquisition of physical transducer data can be achieved through automated means, such as a transducer that converts pressure to an electrical signal being fed to an analog-to-digital converter and then to a recoding means, such as a hard drive in a computer or memory in a microprocessor. Acquisition of service-based activity may be achieved by service rig operator input into a microprocessor-based system. It is contemplated that the transducer data and activity data may be acquired by and stored by the same or different systems, depending the design and requirements of the work-over rig.

In a certain implementation of the invention, it may be desirable to make the acquisition and storage of the data at the well site secure to the extent that the service rig operator or other service company representatives are not able to manipulate or adulterate the data. One implementation of this inventive concept is to not allow error correction in the field. In other words, if the rig operator inadvertently inputs that a tubing pull service has begun when in fact the operation is nippling up the BOP, the operator can immediately input that the tubing pull has ended and input that the nipple up process has started. Additionally or alternatively, the operator may annotate an activity entry, or annotation may be restricted to personnel at the data center. It is also contemplated that the operator (or other inputer) can have complete editorial control over the data (both transducer data and activity data) inputted into the storage system.

The invention contemplates that transducer data and/or activity data from third party service providers will also be inputted into the work-over rig data captive system. For example, third party service vehicles may utilize an identity beacon that emits a signal, such as an electromagnetic signal that is received by the instrumented work-over rig and records the time that the specific service vehicle arrived on site. Alternatively, the rig operator may manually input such information or other means such as magnetic cards or the like may be used. Once on site, transducer data associated with the third party service operation, such as for example, flow rate or pressure, may be communicated to the instrumented rig via wire or wireless communication busses. The rig operator can input third-party activity data in a fashion similar to rig-based activities. In this and similar fashion, the instrumented work-over rig of the present invention can acquire, store and transmit all or substantially all of the physical and activity-based data that is generated by working over an oil well.

Before turning to a detailed description of the current embodiment of the present invention, applicants hereby incorporate by reference the following patents and patent applications: U.S. Pat. No. 6,079,490 entitled "Remotely Accessible Mobile Repair Unit for Wells;" U.S. Pat. No. 6,209,639 entitled "Method of Ensuring That Well Tubing Was Properly Stretched;" U.S. Pat. No. 6,212,763 entitled "Torque-Turn System for a Three-Element Sucker Rod Joint;" U.S. Pat. No. 6,213,207 entitled "Method of Distinguishing Between Installing Different Sucker Rods;" U.S. Pat. No. 6,241,020 entitled "Method of Recording a Cross-Load on a Mobile Repair Unit for a Well;" U.S. Pat. No. 6,253,849 entitled "Method of Distinguishing the Raising and Lowering of Tubing and Sucker Rods;" U.S. Pat. No. 6,276,449 entitled "Engine Speed Control for Joist and Tongs;" U.S. Pat. No. 6,374,706 entitled "Sucker Rod Tool;" U.S. Pat. No. 6,377,189 entitled "Oil Well Servicing System;" U.S. Pat. No. 6,578,634 entitled "Method of Monitoring Pump Operations of a Service Vehicle at a Well Site;" U.S. Ser. No. 10/437,673 entitled "Portable Memory Device for a Mobile Repair Unit;" U.S. Ser. No. 09/839,444 entitled "Method of Managing a Well File Record at a Well Site;" U.S. Ser. No. 09/838,857 entitled "Method of Monitoring Operations of Multiple Service Vehicles at a Well Site;" U.S. Ser. No. 60/428,506 entitled "Crown Out-Floor Out Device for a Well Service Rig;" U.S. Ser. No. 09/839,411 entitled "Method of Managing Workers at a Well Site;" U.S. Ser. No. 10/263,630 entitled "Engine Speed Limiter for a Hoist;" U.S. Ser. No. 09/839,103 entitled "Method of Managing Billing Information at a Well Site;" U.S. Ser. No. 10/113,609 entitled "Servicing System for Wells;" U.S. Ser. No. 10/440,633 entitled "Method of Monitoring Pumping Operations of a Service Vehicle at a Well Site;" U.S. Ser. No. 10/046,688 entitled "Tongs Monitor with Learning Mode;" U.S. Ser. No. 09/839,080 entitled "Method of Managing Work Orders at a Well Site;" U.S. Ser. No. 60/447,342 entitled "Warning Device to Prevent Clutch Burning on a Well Service Rig;" U.S. Ser. No. 60/447,343 entitled "Ergonomics Safety Warning Device and a Method to Prevent Clutch Burning on a Well Service Rig;" and U.S. Ser. No. 60/441,212 entitled "Inventory Counter for Oil & Gas Wells."

Applicants will now describe one embodiment of the present invention. It will be understood that this embodiment is but one way of implementing the present invention and does not necessarily implement all aspects of the invention. Therefore, the embodiment described below should not be construed to limit or define the outer boundaries of the present invention.

Activity Data Capture

The amount of time a service rig spends at a well site can be broken down into discrete activities, each with a measurable beginning and ending time. One example of a typical series of service operations that might be performed at a well include moving onsite and rigging up (MIRU) the workover rig, pulling sucker rods, nippling up the BOP (NUBOP), pulling tubing, other specified operations, running tubing, and well stimulation. Each activity has an identifiable start point which is associated with a certain time, and an identifiable end point that is associated with another certain time so that both the customer and the well service provider can ensure that the work was actually done and done in a timely manner.

Capturing the physical activities that take place at the well site requires the operator of the service vehicle to input what happens at the well site. Operator input is used to capture and classify what activities are taking place at the well site, the time the activities are taking place, any exception events that prevent, restrict, or extend the completion of an activity, and the primary cause and responsible party associated with the exception events. Operator input is obtained by having the operator enter the activity data into a computer or microprocessor as the different service operations are taking place so that the customer and the service provider can have an accurate depiction of what goes on at the well site.

In one embodiment, the operator can simply type the activity information into a computer located at the well site. In another embodiment, a computer is provided to the operator with a number of pre-identified activities already programmed therein. When the operator starts or stops an activity, he can simply push a button associated with the computer to log the stopping or starting of that pre-identified service activity. In a further embodiment, the operator is provided with a hierarchy of service tasks from which to choose from. Preferably, this service hierarchy is designed to be intuitive to the operator, in that the hierarchy is laid out in a manner that is similar to the progression of various service activities at a well site.

Service activities at a well site can generally be divided into three activity identifiers: global day-in/day-out (DIDO) well servicing activities, internal routine activities and external routine activities. DIDO activities are activities that occur almost every day that a service vehicle is at a well site. In the case of a mobile work-over rig, examples of DIDO activities include rigging up the work-over rig, pulling and laying down rods, pulling and laying down tubing, picking up and running tubing, picking up and running rods, and rigging down the work-over rig. Internal routine activities are those that frequently occur during well servicing activities, but aren't necessarily DIDO activities. Example of internal routine activities are rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools. Finally, external routine activities are routine activities that are commonly performed by third parties, such as rigging up/down third party servicing equipment, well stimulation, cementing, logging, perforating, or inspecting the well, and other common servicing tasks.

Figure 1B:
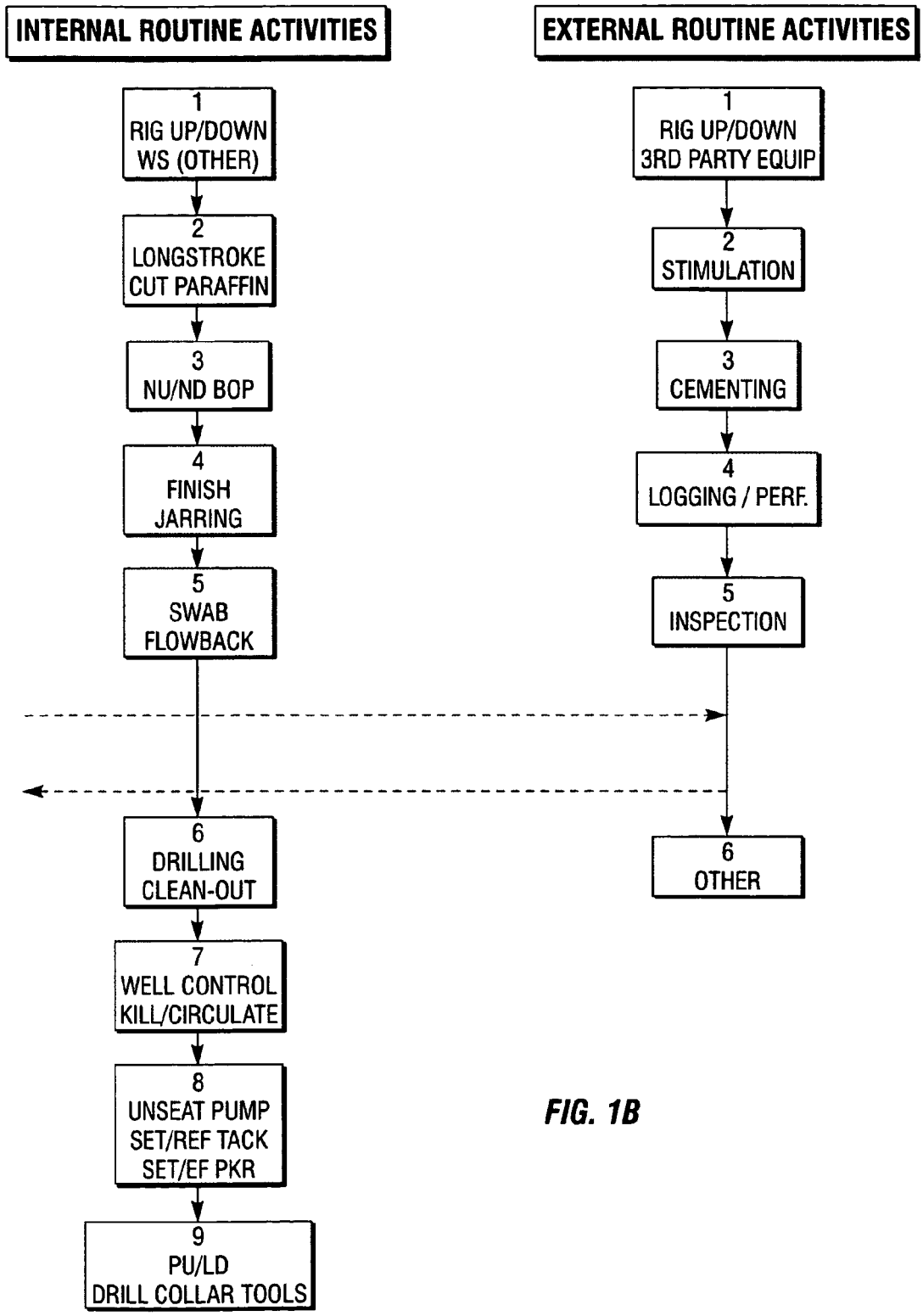

FIGS. 1A–1B illustrate one example of a well servicing activity cycle. The job starts with the typical DIDO activities, shown in FIG. 1A, of rigging up the service unit, pulling and laying down rods, pulling and laying down tubing, and the respective transitions between those activities. After the tubing is pulled, other service activities are performed, most of which are selected from the list of internal routine activities and external routine activities described above and shown in FIG. 1B. After the selected internal and external routine activities are performed, the rig completes the job by picking up and running tubing and rods, and then rigging down the service unit.

In one embodiment, the operator enters the activity identifier (i.e. global day-in/day-out (DIDO) well servicing activities, internal routine activities and external routine activities) into the computer system. After the activity has been identified, the activity is classified based on the operator's subjective determination of how the activity is progressing to completion. The normal, default activity could be classified as "ON TASK: ROUTINE" wherein the job is proceeding according to plan. If for some reason the work is continuing, but not according to plan, two alternate activity classifications would be available to the operator to classify what is happening at the wellsite. Two such classifications could be "ON TASK: EXTEND," in which the job is proceeding according to plan under conditions that may extend task times beyond what is normal, and "ON TASK: RE-SEQUENCE," where the preplanned job sequence has been interrupted, though work has not yet ceased, for example changing from rigging up an auxiliary service unit to nippling up a BOP before the auxiliary service unit is completely rigged up. A single activity can be re-classified at any time while the activity is being performed. For instance, when a service vehicle starts rigging up, the "rig up" activity identifier would likely be classified as "ON TASK: ROUTINE." However, if problems are encountered causing the rigging up time to extend beyond what the normal rigging up time, the "rig up" activity could then be reclassified as "ON TASK: EXTEND."

In some instances, work is completely halted, and these cases, the operator would classify the activity as one of a number of exceptions. One type of exception classifications is "EXCEPTION: SUSPEND", in which ongoing work activity has been interrupted due to a work-site condition and/or event that is temporary, and whose duration is unlikely to be longer than a set period of time, for instance, 10 minutes. Such "EXCEPTION: SUSPEND" conditions are generally non-emergency situations that include anything from a lunch or work break to a visit from the customer to discuss the well servicing operations. Another such exception classification is "EXCEPTION: WAIT" in which the pre-planned work process has been suspended due to the unavailability of a required resource, such as a unavailable personnel, material, or an unavailable third party service. A final type of exception classification is "EXCEPTION: DOWN" in which the preplanned work process has ceased due to unplanned events and/or conditions occurring at the well site. Such unplanned events include change of scope of the service activity, changed well conditions, mechanical failure, weather, unsafe conditions, health and safety training events, and other unplanned events.

In one embodiment, for every activity classification other than "ON TASK: ROUTINE," a variance identifier is assigned to the activity classification linking the reason for the non-routine classification to its source. If the activity classification is "ON TASK: EXTEND," "ON TASK: RESEQUENCE," or "EXCEPTION SUSPEND," the variance identifier could be any of the aforementioned reasons for classifying exceptions, such as "SERVICE AVAILABILITY," "MATERIAL AVAILABILITY," "PERSONNEL AVAILABILITY," "SCOPE CHANGE," "WELL CONDITION CHANGE," "MECHANICAL FAILURE," "WEATHER, UNSAFE CONDITION," "HEALTH AND SAFETY EVENT," "WORK BREAK," or other change in the work conditions. As described earlier, if the activity classification is "EXCEPTION: WAIT," the variance identifier would be selected from as "SERVICE AVAILABILITY," "MATERIAL AVAILABILITY," or "PERSONNEL AVAILABILITY," because "EXCEPTION: WAIT" is the activity classification in which the pre-planned work process has been suspended due to the unavailability of a required resource. If the activity classification is "EXCEPTION: DOWN," the variance identifier would be selected from the group comprising "SCOPE CHANGE," "WELL CONDITION CHANGE," "MECHANICAL FAILURE," "WEATHER, UNSAFE CONDITION," "HEALTH AND SAFETY EVENT," "WORK BREAK," or other unanticipated change in the work conditions. This is because the "EXCEPTION: DOWN" activity classification covers exceptions in which the preplanned work process has ceased due to unplanned events and/or conditions occurring at the well site.

After the variance identifier has been selected, the variance must be classified appropriately so as to be assigned to a responsible party. Generally, the responsible party will be the well service provider, a third party, or the customer. In one embodiment, the variance classification will be selected between "WELL SERVICE PROVIDER," "CUSTOMER" or "3RD PARTY." After the variance classification has been selected, the operator is done entering information in to the computer until the present activity is completed or the next activity started.

Figure 2:
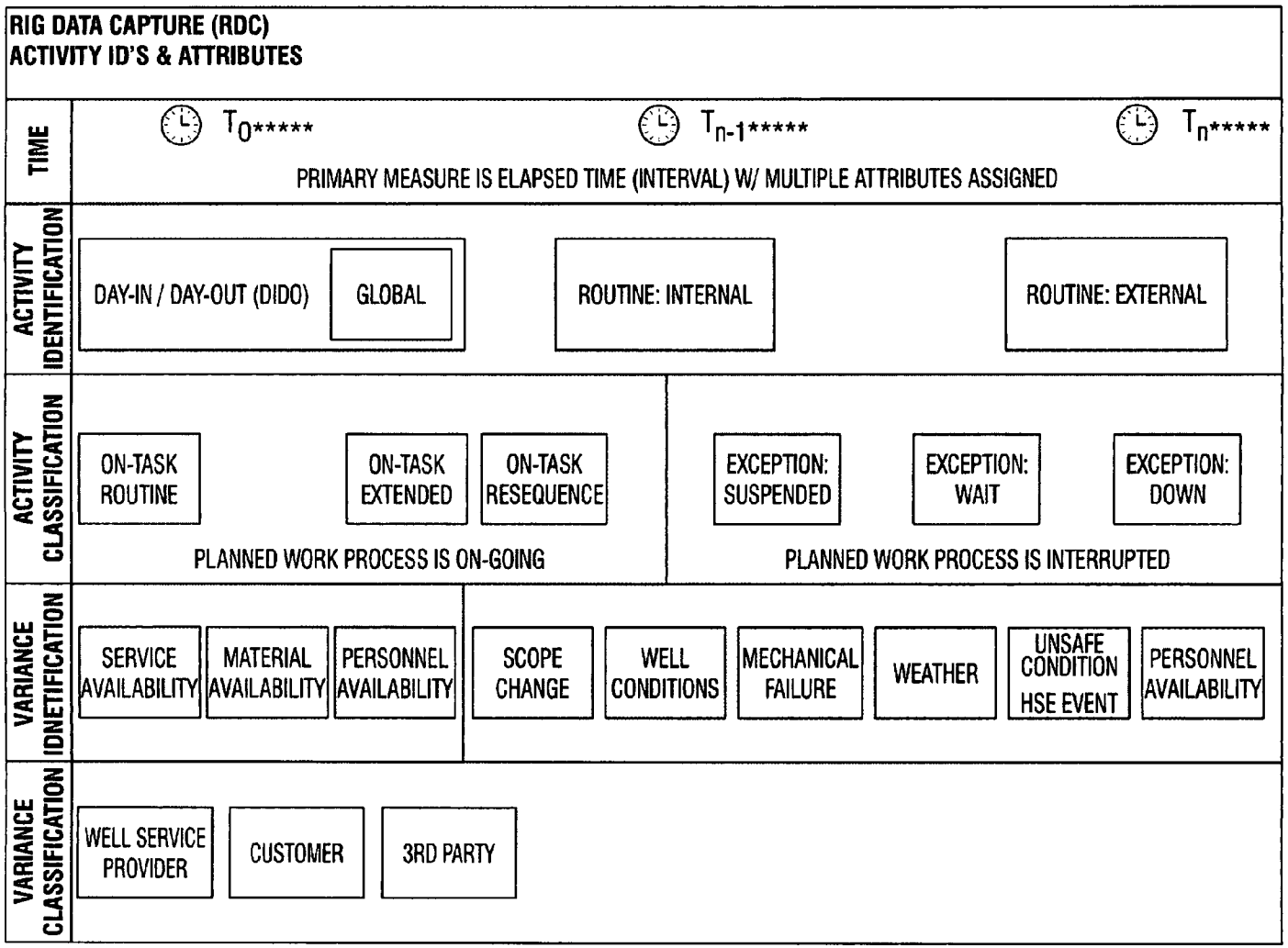
FIG. 2 illustrates one embodiment an activity capture methodology outlined in tabular form.

Referring to FIG. 2, one embodiment of the aforementioned activity capture methodology is outlined in tabular form. As is shown in FIG. 2, an operator first chooses an activity identifier for his/her upcoming task. If "GLOBAL" is chosen, then, as shown in FIG. 1A, the operator would choose from rig up/down, pull/run tubing or rods, or laydown/pickup tubing and rods (options not shown in FIG. 2). If "ROUTINE: INTERNAL" is selected, then the operator would choose from rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools, as shown in FIG. 1B. Finally, if "ROUTINE: EXTERNAL" is chosen, the operator would then select one an activity that is being performed by a third party, such as rigging up/down third party servicing equipment, well stimulation, cementing, logging, perforating, or inspecting the well, and other common third party servicing tasks, as shown in FIG. 1B. After the activity is identified, it is classified. For all classifications other than "ON TASK: ROUTINE," a variance identifier is selected, and then classified using the variance classification values.

Figure 3:
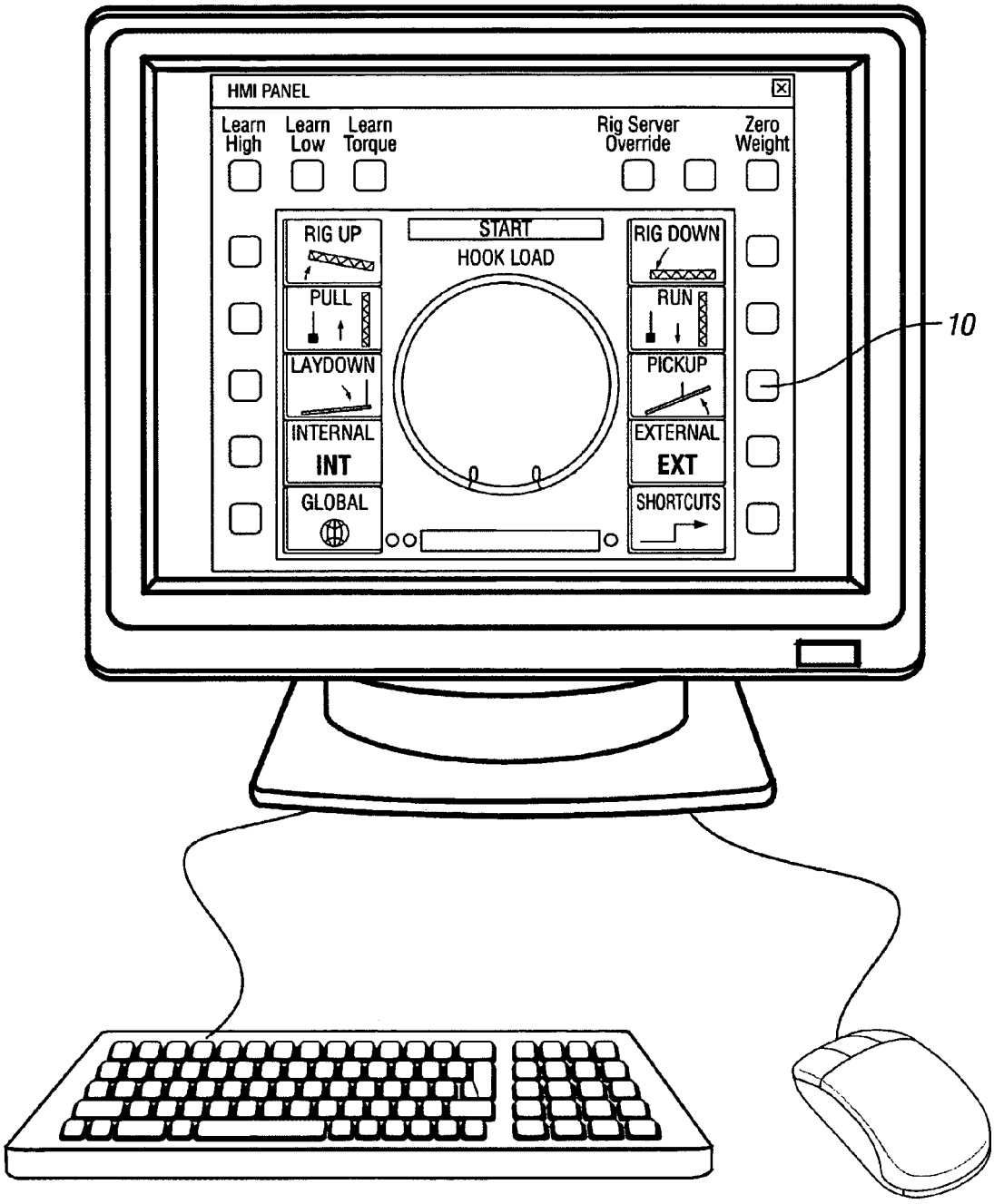
FIG. 3 shows one example of an operator interface.

As explained above, all that is required from the operator is that he or she enter in the activity data into a computer. The operator can interface with the computer using a variety of means, including typing on a keyboard or using a touchscreen. In one embodiment, a screen with pre-programmed buttons (10) is provided to the operator, such as the one shown in FIG. 3, which allows the operator to simply select the activity from a group of pre-programmed buttons. For instance, if the operator were presented with the screen of FIG. 3 upon arriving at the well site, the operator would first press the "RIG UP" button. The operator would then be presented with the option to select, for example, "SERVICE UNIT," "AUXILIARY SERVICE UNIT," or "THIRD PARTY." The operator then would select whether the activity was on task, or if there was an exception, as described above.

Figure 4:
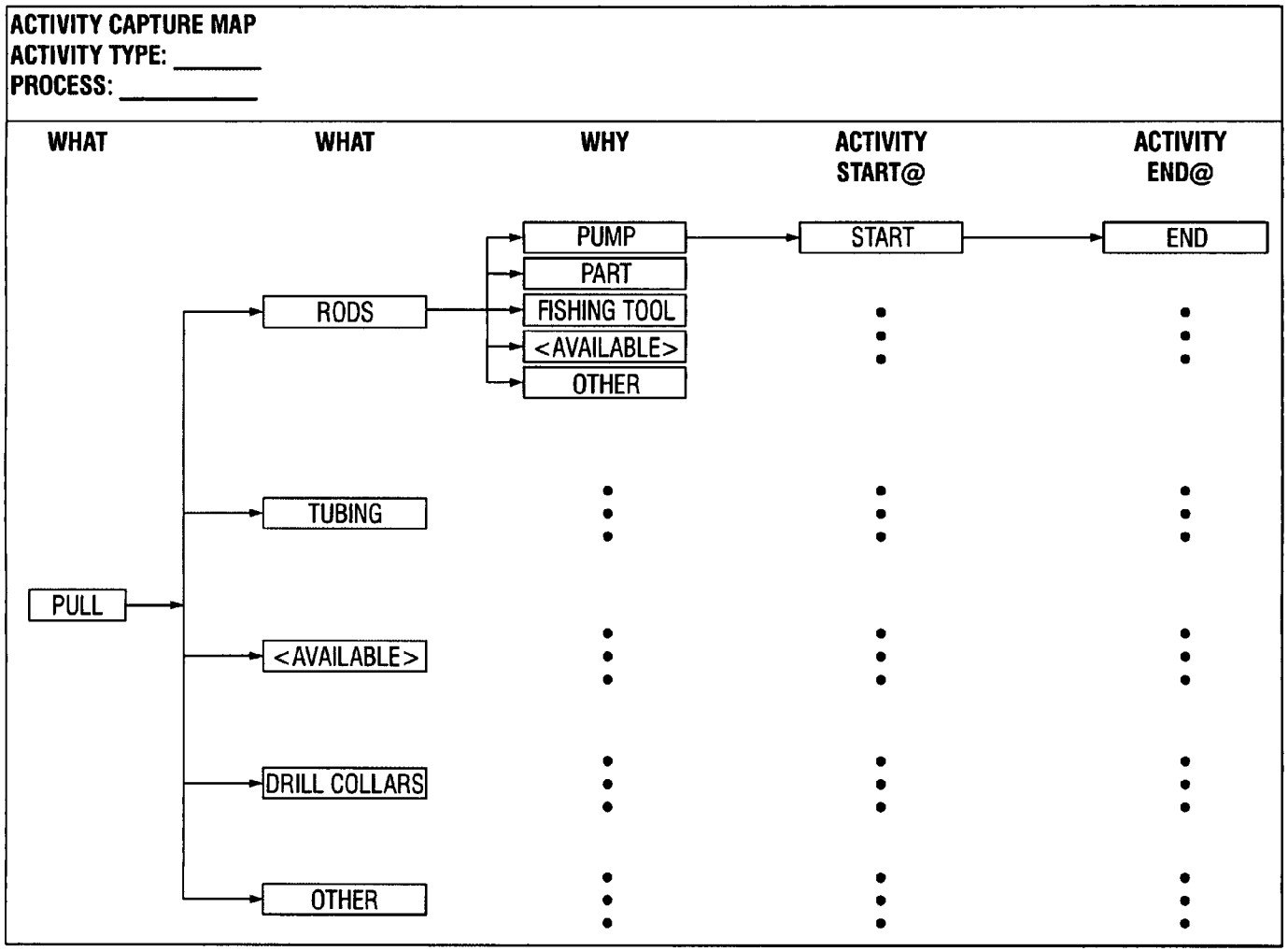
FIG. 4 shows one example of an activity capture map of the present invention.

An example of an activity capture map for pulling operations is shown in FIG. 4. If an operator were to select "PULL" from the top screen, he would then have the option to select between "RODS," "TUBING," "DRILL COLLARS," or "OTHER." If the operator chose "RODS," the operator would then choose from "PUMP," "PART," "FISHING TOOL," or "OTHER." The operator would be trained on the start and stop times for each activity, as shown in the last to columns of FIG. 4 so that the operator could appropriately document the duration of the activity at the well site. Each selection would have its own subset of tasks, as described above, but for ease of understanding, only those pulling rods or shown in FIG. 4.

Figure 5:
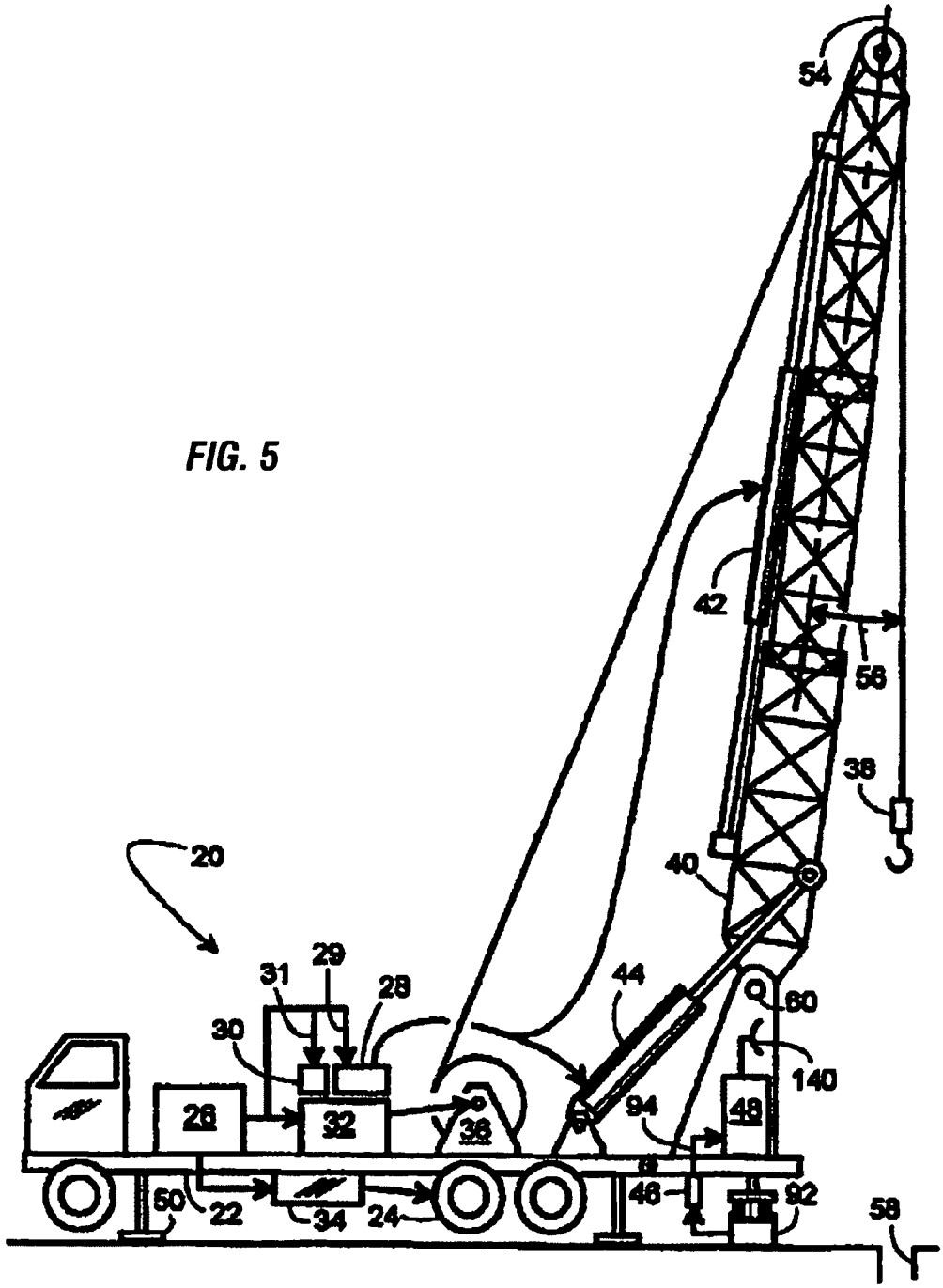
FIG. 5 is a side view of a mobile repair unit with its derrick extended.

In one embodiment of the present invention, the activity data is gathered by the computer along with process data from the well service vehicle, such as is described in U.S. Pat. No. 6,079,490, which is hereby incorporated by reference. Referring to FIG. 5, a retractable, self-contained mobile repair unit 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50. Monitor 48, of special importance to the disclosed invention, receives amongst other things various parameters measured during the mobile repair unit's operation.

Figure 8:
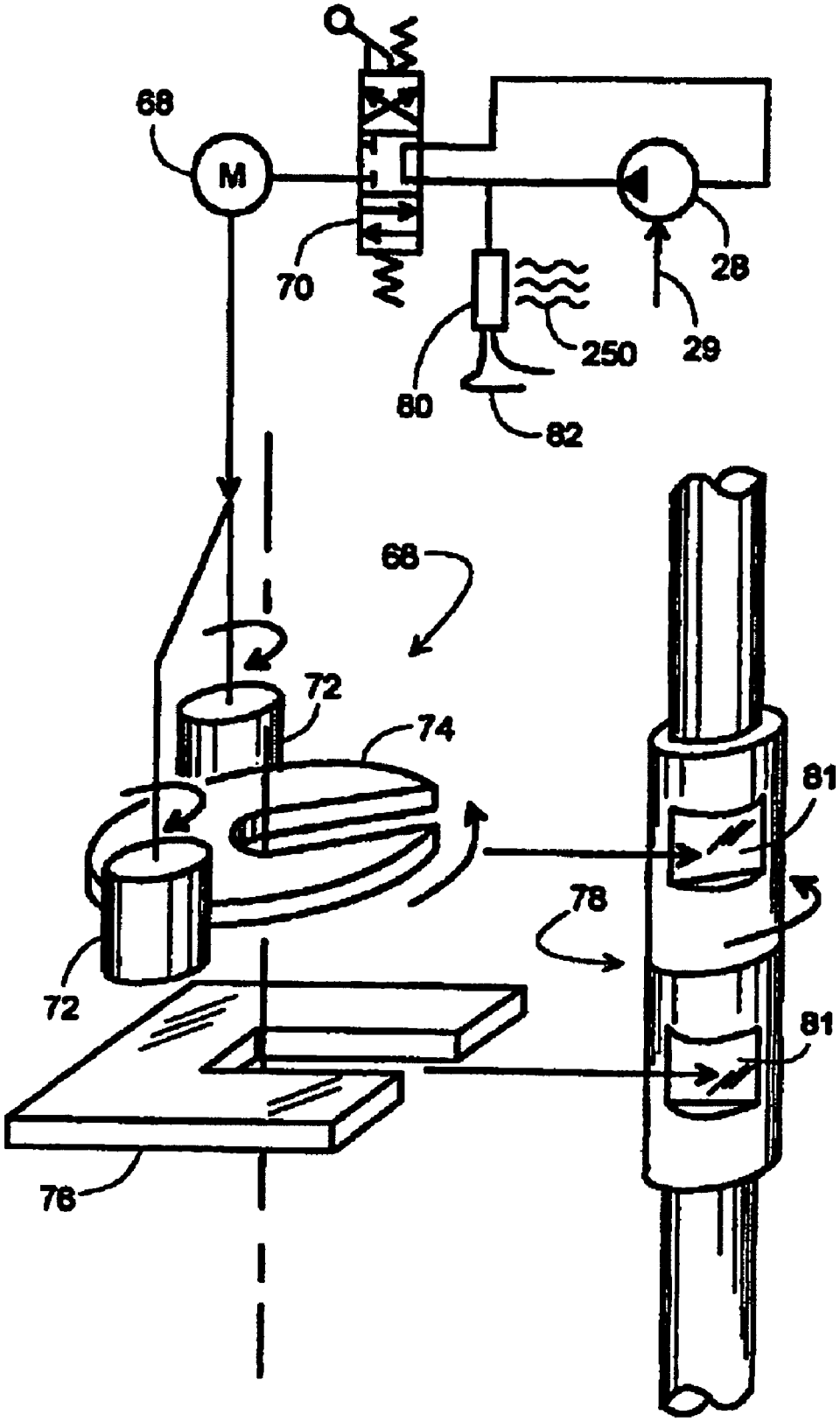
FIG. 8 is a schematic illustration of a set of hydraulic tongs.
Figure 9:
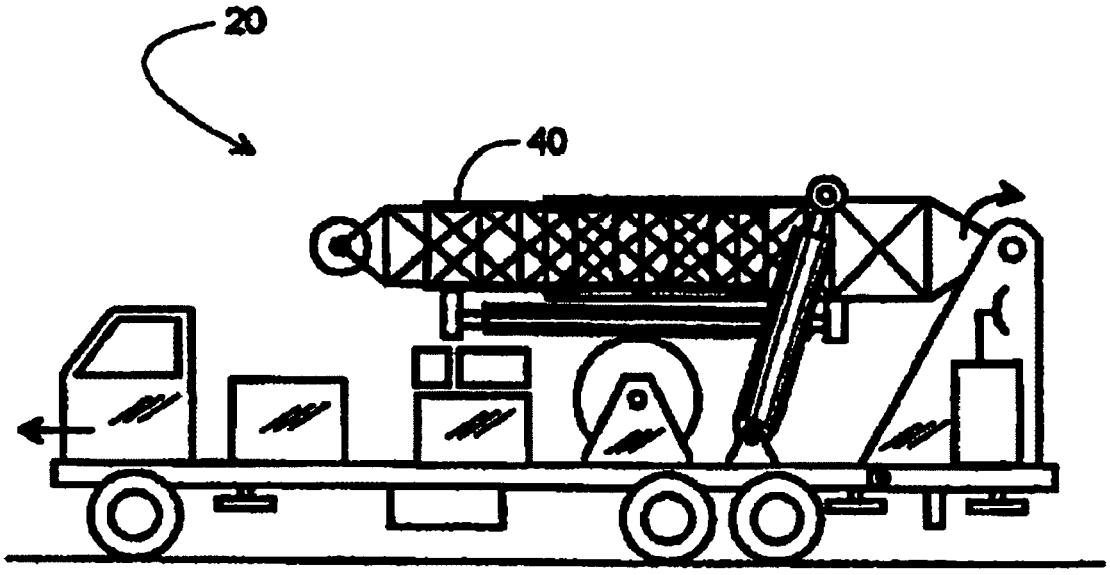
FIG. 9 is a side view of a mobile repair unit with its derrick retracted.
Figure 10:
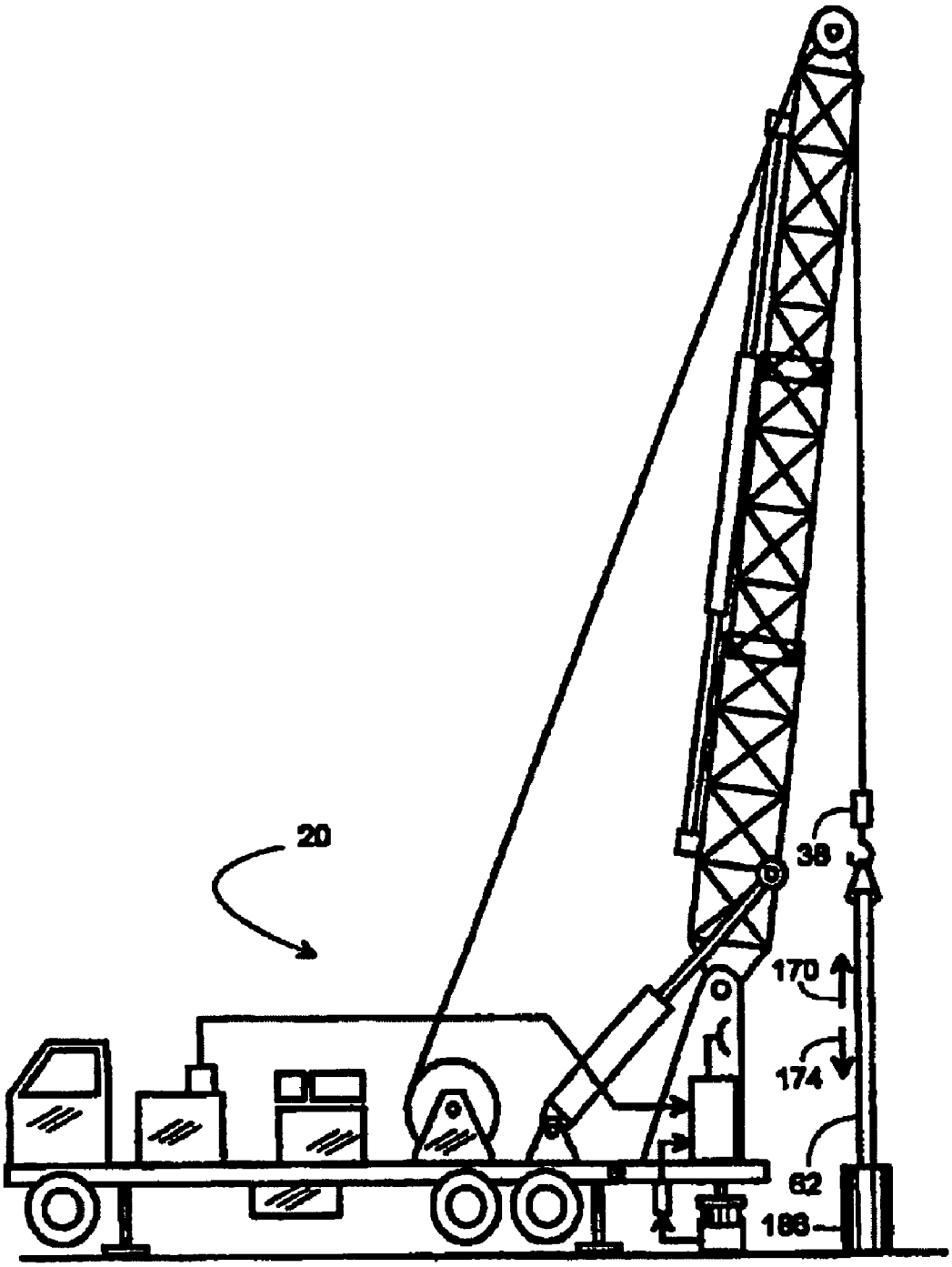
FIG. 10 illustrates the raising and lowering of an inner tubing string.

Engine 26 selectively couples to wheels 24 and hoist 36 by way of transmissions 34 and 32, respectively. Engine 26 also drives hydraulic pump 28 via line 29 and air compressor 30 via line 31. Compressor 30 powers a pneumatic slip 84 (FIGS. 6 and 7), and pump 28 powers a set of hydraulic tongs 66 (FIG. 8). Pump 28 also powers cylinders 42 and 44 that respectively extend and pivot derrick 40 to selectively place derrick 40 in a working position (FIG. 5) and in a retracted position (FIG. 9). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments (i.e., inner pipe strings 62) and sucker rods (FIG. 10).

Individual pipe segments (of string 62) and sucker rods 64 are screwed together using hydraulic tongs 66 (FIG. 8). Hydraulic tongs are known in the art, and refer to any hydraulic tool that can screw together two pipes or sucker rods, such as those provided by B.J. Hughes company of Houston, Tex. In operation, pump 28 drives a hydraulic motor 68 in either forward or reverse directions by way of valve 70. Motor 68 drives pinions 72 that turn a wrench element 74 relative to clamp 76. Wrench element 74 and clamp 76 engage flats 81 on mating couplings 78 of a sucker rod or inner pipe string. However, rotational jaws or grippers that hydraulically clamp on to a round pipe (i.e., with no flats) can also be used in place of the disclosed wrench element 74. The rotational direction of motor 68 determines whether the couplings 78 are assembled or disassembled.

The transducer 80 of FIG. 8 detects by feedback the amount of torque that is used to assemble or disassemble the string 62 or sucker rods 64, and provides an analog signal 82 (e.g., from 0–5 Volts DC) indicative of that torque value. This signal 82 is provided to monitor 48 and is stored in a manner to be described shortly.

Figure 6:
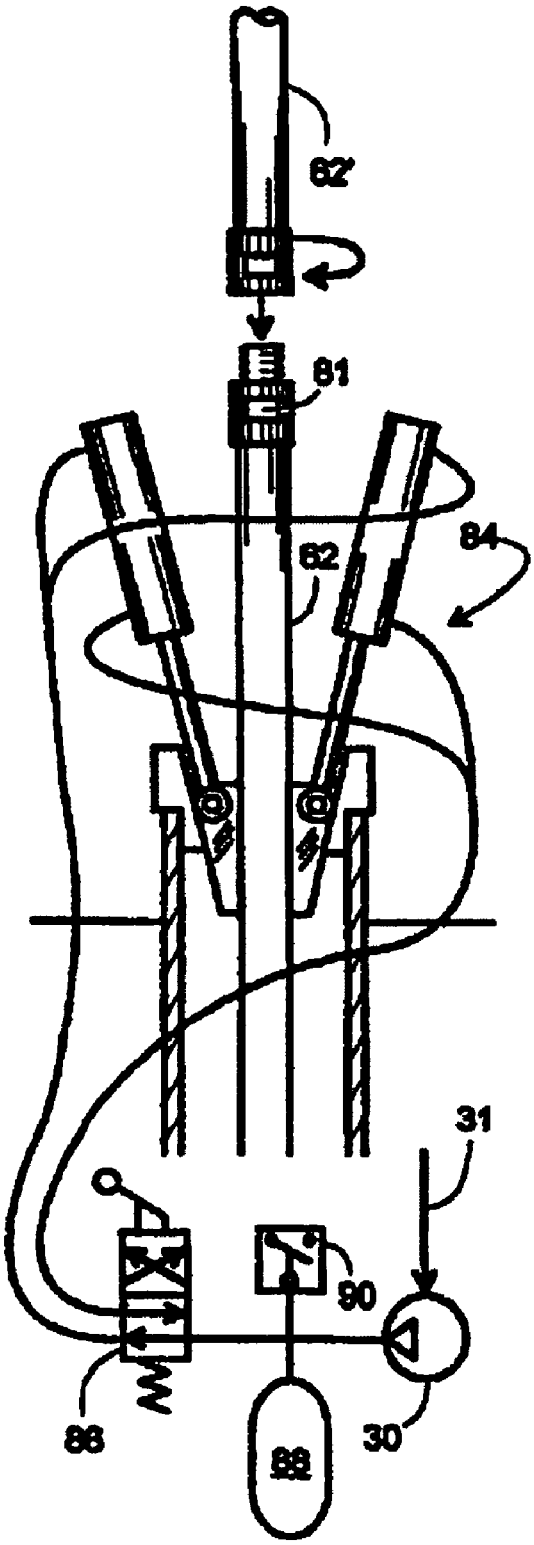
FIG. 6 is a schematic view of a pneumatic slip in a locked position.
Figure 7:
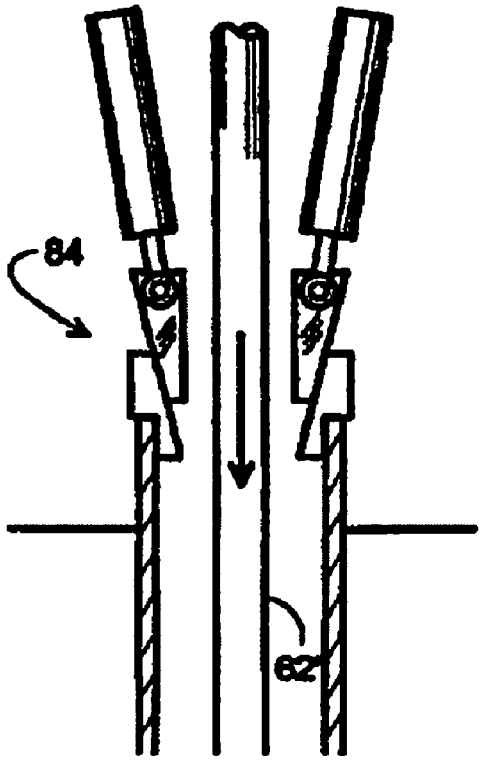
FIG. 7 is a schematic view of a pneumatic slip in an open position.

Referring to FIGS. 6 and 7, when installing inner pipe string segments 62, pneumatic slip 84 is used to hold the pipe string 62 while the next segment 62' is screwed on using tongs 66 as just described. Compressor 30 provides pressurized air through valve 86 to rapidly clamp and release slip 84, as shown in FIGS. 6 and 7 respectively. A tank 88 helps maintain constant air pressure. Pressure switch 90, a type of transducer, provides monitor 48 with a signal that indirectly indicates that repair unit 20 is in operation.

Referring back to FIG. 5, weight applied to block 38 is sensed by way of a hydraulic pad 92 that supports the weight of derrick 40. Hydraulic pad 92 is basically a piston within a cylinder such as those provided M. D. Totco company of Cedar Park, Tex., but can alternatively constitute a diaphragm. Hydraulic pressure in pad 92 increases with increasing weight on block 38, and this pressure can accordingly be monitored to assess the weight of the block. Thus, pad 92 constitutes another type of transducer, and it too transmits a signal (not shown) to the monitor 48.

In short, and as is well known, the mobile repair unit contains numerous tools for performing various repair tasks, and most of these tools contain some sort of transducer for providing an indication of the work being performed. (As used herein, "transducer" should be understood as any sort of detector, sensor, or measuring device for providing a signal indicative of the work being performed by a particular tool). Using such transducers, important parameters can be measured or monitored, such as hook load, tong torque, engine RPM, hydrogen sulfide concentration, a block position encoder for determining where the block is in is travel, engine oil pressure, clutch air pressure, global positioning system monitor, and any other sensor that might provide data worth monitoring by the well service provider.

As noted, of the signals provide by the various transducers associates with the tools are sent to data acquisition monitor 48. The primary objective of monitor 48 is to gather well maintenance data and save it so that it can be transferred and subsequently monitored at a site other than the location of the mobile repair unit, such as a central office site. Monitor 48 is generally installed in an openly accessible location on the mobile repair unit. For example, on a mobile repair unit, monitor 48 is installed somewhere outside the cab for easy access by human operators who may walk up to the mobile repair unit to interface with the system and collect data. In addition to storing the measured data from the tools, the monitor 48 may also include a screen display for displaying the data.

The signals provide by the various transducers associates with the tools can be sent to the same or a different computer at which the operator enters the activity data at the will. The computer can then gather well maintenance data and save it so that it can be correlated to the activity data entered by the operator. In one embodiment, the process data can be displayed on a screen for the operators to review. In yet another embodiment, the activity data and the process data can be transferred and subsequently monitored at a site other than the location of the mobile repair unit, such as a centrally located office site. In one embodiment, the activity and process data is transferred using a modem and cellular phone arrangement such as is described in U.S. Pat. No. 6,079,490. In other embodiments, the data is transferred using other types of wireless communication, such as via a satellite hookup. The data can also be transferred using a hard disk medium, wherein the data is saved on a floppy disk, CD, or other memory storage device and physically transferred to the central office site. There are a wide variety means to transfer the data from the well site to the central office site, and such means are widely known in the art.

If it is chosen to send the data to a centrally located office site, the well service provider could then have instant access to data and activity information pertaining to the wells service operations at the well. In some embodiments, the well service provider can make the information instantly available on the internet for the customer to view as well. For example, in FIG. 11 the well service provider could make the information available on the internet in a variety of web page formats, including, for example, a summary page, a page describing the activity information, and a process data page. A customer could then select one of the well information selections, and would be directed to an exception reporting page, such as is shown in FIG. 11, where an outline of each and every activity data point entered in by the operator at the well site is shown.

As seen in the case of the exception reporting page illustrated in FIG. 11, most of the activities in this instance were "ON TASK: ROUTINE," with two exceptions. The exceptions did not stop the work, as each was classified as being "ON TASK: EXTEND," but it indicates to the customer that one of the activities took longer than normal because of a mechanical failure. This provides both the well service provider and the customer with valuable data pertaining to what actually went on at the well site. In some embodiments, notes can be added to the web page clarifying some of the exceptions. As shown in FIG. 11, one exception was noted and added to the website, with the notes clarifying the exception as being a "Mechanical failure: (47 min)." In some embodiments, the operator can enter the notes into the activity data log at the well site.

Figure 12:
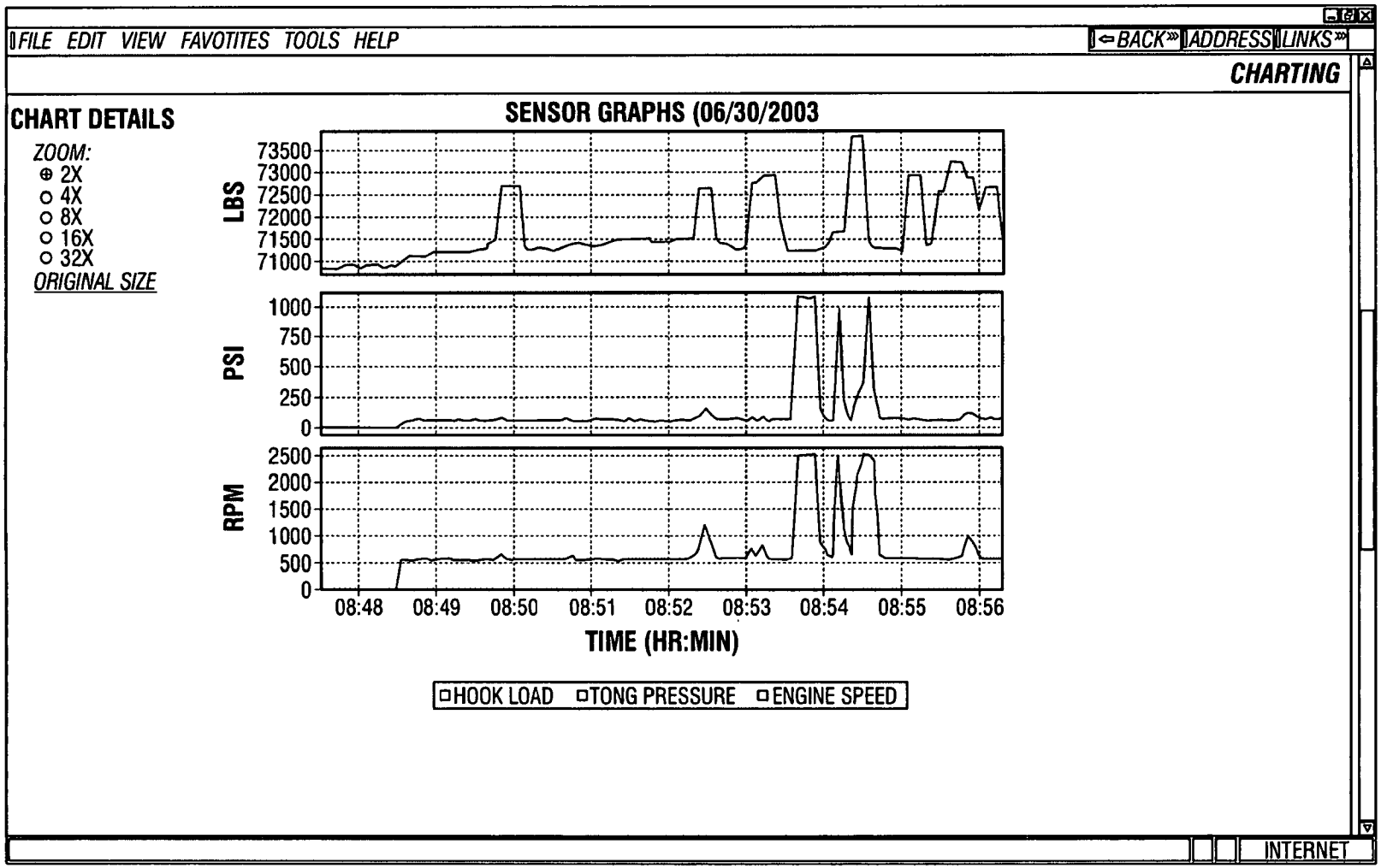
FIG. 12 shows one example of available sensor data for viewing by a customer.

Finally, as shown on the top portion of FIG. 11 and in greater detail in FIG. 12, the web user can select certain transducer data to view on the web page. For example, in FIG. 12 hook load in pounds, tong pressure in pounds per square inch, and engine speed in rpm are shown as a function of rig time. The well service provider and the customer can use this data, in some embodiments in conjunction with the activity information, to determine if the well service operations were efficient and performed correctly. This is a very valuable tool for increasing efficiency and productivity of well servicing operations, as well as providing the customer with information that they are getting their moneys worth from their well service provider.

Although the invention is described with reference to various embodiments, it should be appreciated by those skilled in the art that various modifications are well within the scope of the invention. For example, many of the illustrative embodiments were based on one example of activity data reporting using a pre-programmed hierarchy of activities for the operator to enter into the computer. However, it should be recognized, as was explained above, that this is just one example of capturing activity information at a well site. The operator could simply type in activity data into the computer, or a completely different hierarchy of activities could be developed. It is within the skill of one in the art of well servicing to tailor how the activity data is to be captured at the well site, the important aspect being that activity data is actually captured.

We claim:

1. A method of servicing a well at a wellsite, comprising:

measuring a variable associated with servicing the well, electronically recording the measured variable on a first computer;

inputting non-numerical activity data associated with servicing the well into a second computer;

transferring the electronically recorded measured variable and activity data from the wellsite to a central location.

2. The method of claim 1, wherein the measured variable is selected from the group consisting of hook load, tong torque, engine RPM, hydrogen sulfide concentration, block position, engine oil pressure, clutch air pressure, and global position.

3. The method of claim 1, wherein the non-numerical activity is selected from the group consisting of rigging up a well service unit, pulling rods, pulling tubing, running tubing, running rods, rigging down the well service unit, nippling up a BOP, nippling down a BOP, fishing, jarring, swabbing, drilling, clean out, killing the well, circulating fluid, unseating pumps, setting a tubing anchor, releasing a tubing anchor, setting a packer, releasing a packer, well stimulation, cementing, logging, perforating, and inspecting the well.

4. The method of claim 1, wherein the means of transferring the electronically recorded measured variable and activity data from the wellsite to a central location is selected from the group consisting of transmitting via a modem over a cellular phone, transmitting via a satellite hookup, transmitting via a wireless communication device, and transmitting by saving the recorded measured variable and activity data on a data storage medium and physically transferring the data storage medium to the central location.

5. The method of claim 4, wherein the data storage medium is selected from the group consisting of a floppy disk, CD, and memory storage device.

6. The method of claim 1, wherein after the electronically recorded measured variable is transferred to the central location, it is made available on the INTERNET.

7. The method of claim 1, wherein after the electronically recorded activity data is transferred to the central location, it is made available on the INTERNET.

8. The method of claim 1, wherein the first computer and the second computer are the same.

9. The method of claim 1, wherein the non-numerical activity data associated with servicing the well is inputted into the second computer by typing it in using a keyboard.

10. The method of claim 1, wherein the non-numerical activity data associated with servicing the well is inputted into the second computer by pressing a pre-programmed button associated with a specific activity.

11. The method of claim 10, wherein the pre-programmed buttons provide a hierarchy of non-numerical activity data available for input.

12. The method of claim 11, wherein the hierarchy of non-numerical activity is broken down in to activity identifiers.

13. The method of claim 12, wherein the activity identifiers are selected from the group consisting of global day in/day out well servicing activities, internal routine activities, and external routine activities.

14. The method of claim 13, wherein the global day in/day out well servicing activities are selected from the group consisting of rigging up a work-over rig, pulling rods, laying down rods, pulling tubing, laying down tubing, picking up tubing, running tubing, picking up rods, running rods, and rigging down the work-over rig.

15. The method of claim 13, wherein the internal routine activities are selected from the group consisting of rigging up an auxiliary service unit, rigging down an auxiliary service unit, longstroke, cut paraffin, nipple up a BOP, nipple down a BOP, fishing, jarring, swabbing, flowback, drilling, clean out, well control activities, killing a well, circulating fluid within a well, unseating pumps, setting a release tubing anchor, releasing a tubing anchor, setting a packer, releasing a packer, picking up drill collars, laying down drill collars, picking up tools, and laying down tools.

16. The method of claim 13, wherein the internal routine activities are selected from the group consisting of rigging up third party servicing equipment, rigging down third party servicing equipment, well stimulation, cementing, logging, perforating, and inspecting the well.

17. The method of claim 1, wherein the non-numerical activity data is classified with a progression classification based on how the activity is progressing to completion.

18. The method of claim 17, wherein a variance identifier is assigned to each progression classification.

19. The method of claim 18, wherein the variance identifier describes a change in work conditions.

20. The method of claim 17, wherein the activity classifications are selected from the group consisting of "on task: routine," "on task: extend," "on task: re-sequence," "exception: suspend," "exception: wait," and "exception down."

21. The method of claim 17, wherein the non-numerical activity data can be changed at any time.

22. The method of claim 1, wherein the measured variable and the activity data are provided by a third party service provider.

23. The method of claim 22, wherein the third party service provider communicates with the first or second computer using a method selected from the group consisting of an electromagnetic signal, a magnetic identity card, a wired communication device, or a wireless communication device.

24. A mobile well service vehicle, comprising:

a transducer for measuring a variable associated with servicing a well, a means for electronically recording the measured variable, a means for electronically recording non-numerical activity data associated with servicing the well;

a means for transferring the electronically recorded measured variable and activity data from the wellsite to a central location.

25. The mobile well service vehicle of claim 24, wherein the measured variable is selected from the group consisting of hook load, tong torque, engine RPM, hydrogen sulfide concentration, block position, engine oil pressure, clutch air pressure, and global position.

26. The mobile well service vehicle of claim 24, wherein the non- numerical activity is selected from the group consisting of rigging up a well service unit, pulling rods, pulling tubing, running tubing, running rods, rigging down the well service unit, nippling up a BOP, nippling down a BOP, fishing, jarring, swabbing, drilling, clean out, killing the well, circulating fluid, unseating pumps, setting a tubing anchor, releasing a tubing anchor, setting a packer, releasing a packer, well stimulation, cementing, logging, perforating, and inspecting the well.

27. The mobile well service vehicle of claim 24, wherein the means of transferring the electronically recorded measured variable and activity data from the wellsite to a central location is selected from the group consisting of transmitting via a modem over a cellular phone, transmitting via a satellite hookup, transmitting via a wireless communication device, and transmitting by saving the recorded measured variable and activity data on a data storage medium and physically transferring the data storage medium to the central location.

28. The mobile well service vehicle of claim 27, wherein the data storage medium is selected from the group consisting of a floppy disk, CD, and memory storage device.

29. The mobile well service vehicle of claim 24, wherein the means for electronically recording the measured variable and the means for electronically recording non-numerical activity data associated with servicing the well are the same.

30. The mobile well service vehicle of claim 24, wherein means for recording the non-numerical activity data associated with servicing the well is entering the data into a computer using a keyboard.

31. The mobile well service vehicle of claim 24, wherein means for recording the non-numerical activity data associated with servicing the well is entering the data into a computer using pre-programmed buttons associated with a specific activity.

32. The mobile well service vehicle of claim 31, wherein the pre-programmed buttons provide a hierarchy of non-numerical activity data available for input.

33. The mobile well service vehicle of claim 32, wherein the hierarchy of non-numerical activity is broken down in to activity identifiers.

34. The mobile well service vehicle of claim 33, wherein the activity identifiers are selected from the group consisting of global day in/day out well servicing activities, internal routine activities, and external routine activities.

35. The mobile well service vehicle of claim 34, wherein the global day in/day out well servicing activities are selected from the group consisting of rigging up a work-over rig, pulling rods, laying down rods, pulling tubing, laying down tubing, picking up tubing, running tubing, picking up rods, running rods, and rigging down the work-over rig.

36. The mobile well service vehicle of claim 34, wherein the internal routine activities are selected from the group consisting of rigging up an auxiliary service unit, rigging down an auxiliary service unit, longstroke, cut paraffin, nipple up a BOP, nipple down a BOP, fishing, jarring, swabbing, flowback, drilling, clean out, well control activities, killing a well, circulating fluid within a well, unseating pumps, setting a release tubing anchor, releasing a tubing anchor, setting a packer, releasing a packer, picking up drill collars, laying down drill collars, picking up tools, and laying down tools.

37. The mobile well service vehicle of claim 34, wherein the internal routine activities are selected from the group consisting of rigging up third party servicing equipment, rigging down third party servicing equipment, well stimulation, cementing, logging, perforating, and inspecting the well.

38. The mobile well service vehicle of claim 24, wherein the non-numerical activity data is classified with a progression classification based on how the activity is progressing to completion.

39. The mobile well service vehicle of claim 38, wherein a variance identifier is assigned to each progression classification.

40. The mobile well service vehicle of claim 39, wherein the variance identifier describes a change in work conditions.

41. The mobile well service vehicle of claim 38, wherein the activity classifications are selected from the group consisting of "on task:routine," "on task: extend," "on task: re-sequence," "exception: suspend," "exception: wait," and "exception down."

42. The mobile well service vehicle of claim 38, wherein the non-numerical activity data can be changed at any time.

43. A method of servicing a well at a wellsite, comprising:

inputting non-numerical activity data associated with servicing the well into a computer;

transferring the non-numerical activity data from the wellsite to a central location.

44. The method of claim 43, wherein the non-numerical activity is selected from the group consisting of rigging up a well service unit, pulling rods, pulling tubing, running tubing, running rods, rigging down the well service unit, nippling up a BOP, nippling down a BOP, fishing, jarring, swabbing, drilling, clean out, killing the well, circulating fluid, unseating pumps, setting a tubing anchor, releasing a tubing anchor, setting a packer, releasing a packer, well stimulation, cementing, logging, perforating, and inspecting the well.

45. The method of claim 43, wherein the means of transferring the electronically recorded activity data from the wellsite to a central location is selected from the group consisting of transmitting via a modem over a cellular phone, transmitting via a satellite hookup, transmitting via a wireless communication device, and transmitting by saving the recorded measured variable and activity data on a data storage medium and physically transferring the data storage medium to the central location.

46. The method of claim 45, wherein the data storage medium is selected from the group consisting of a floppy disk, CD, and memory storage device.

47. The method of claim 43, wherein after the electronically recorded activity data is transferred to the central location, it is made available on the INTERNET.

48. The method of claim 43, wherein the non-numerical activity data associated with servicing the well is inputted into the computer by typing it in using a keyboard.

49. The method of claim 43, wherein the non-numerical activity data associated with servicing the well is inputted into the computer by pressing a pre-programmed button associated with a specific activity.

50. The method of claim 49, wherein the pre-programmed buttons provide a hierarchy of non-numerical activity data available for input.

51. The method of claim 50, wherein the hierarchy of non-numerical activity is broken down in to activity identifiers.

52. The method of claim 51, wherein the activity identifiers are selected from the group consisting of global day in/day out well servicing activities, internal routine activities, and external routine activities.

53. The method of claim 52, wherein the global day in/day out well servicing activities are selected from the group consisting of rigging up a work-over rig, pulling rods, laying down rods, pulling tubing, laying down tubing, picking up tubing, running tubing, picking up rods, running rods, and rigging down the work-over rig.

54. The method of claim 52, wherein the internal routine activities are selected from the group consisting of rigging up an auxiliary service unit, rigging down an auxiliary service unit, longstroke, cut paraffin, nipple up a BOP, nipple down a BOP, fishing, jarring, swabbing, flowback, drilling, clean out, well control activities, killing a well, circulating fluid within a well, unseating pumps, setting a release tubing anchor, releasing a tubing anchor, setting a packer, releasing a packer, picking up drill collars, laying down drill collars, picking up tools, and laying down tools.

55. The method of claim 52, wherein the internal routine activities are selected from the group consisting of rigging up third party servicing equipment, rigging down third party servicing equipment, well stimulation, cementing, logging, perforating, and inspecting the well.

56. The method of claim 43, wherein the non-numerical activity data is classified with a progression classification based on how the activity is progressing to completion.

57. The method of claim 56, wherein a variance identifier is assigned to each progression classification.

58. The method of claim 57, wherein the variance identifier describes a change in work conditions.

59. The method of claim 56, wherein the activity classifications are selected from the group consisting of "on task: routine," "on task: extend," "on task: re-sequence," "exception: suspend," "exception: wait," and "exception down."

60. The method of claim 56, wherein the non-numerical activity data can be changed at any time.

61. The method of claim 43, wherein the activity data is provided by a third party service provider.

62. The method of claim 61, wherein the third party service provider communicates with the computer using a method selected from the group consisting of an electromagnetic signal, a magnetic identity card, a wired communication device, or a wireless communication device.

* * * * *

US007006920C1

(12) EX PARTE REEXAMINATION CERTIFICATE (8812th)

United States Patent

Newman et al.

(10) Number: US 7,006,920 C1

(45) Certificate Issued: Jan. 17, 2012

(54) ACTIVITY DATA CAPTURE SYSTEM FOR A WELL SERVICE VEHICLE

(75) Inventors: Frederic M. Newman, Midland, TX (US); Paul Herring, Midland, TX (US)

(73) Assignee: Bank of America, N.A., Dallas, TX (US)

Reexamination Request:
No. 90/011,574, Apr. 28, 2011

Reexamination Certificate for:

| | |
|---|---|
| Patent No.: | **7,006,920** |
| Issued: | **Feb. 28, 2006** |
| Appl. No.: | **10/957,309** |
| Filed: | **Oct. 1, 2004** |

Related U.S. Application Data

(60) Provisional application No. 60/508,730, filed on Oct. 3, 2003.

(51) Int. Cl.
*G01V 9/00* (2006.01)

(52) U.S. Cl. ..... 702/6

(58) Field of Classification Search ..... 702/6
See application file for complete search history.

(56) References Cited

To view the complete listing of prior art documents cited during the proceeding for Reexamination Control Number 90/011,574, please refer to the USPTO's public Patent Application Information Retrieval (PAIR) system under the Display References tab.

*Primary Examiner*—My-Trang Nu Ton

(57) ABSTRACT

The present invention is directed to incrementing a well service rig in such a manner that activity-based and/or time-based data for the well site is recorded. The acquired data can be transmitted via wired, wireless, satellite or physical to a data center preferably controlled by the work-over rig owner, but alternately controlled by the well owner or another. The data can thereafter be used to provide the customer a detailed invoice or a searchable, secure web-based database. With such information, the customer can schedule other services at the well site. Further, the customer will have access to detailed data on the actual service performed. The present invention fosters a synergistic relationship among the customer and the service companies that promotes a safe environment by monitoring crew work activities and equipment speeds; improving productivity; reducing operation expenses through improved job processes; and better data management and reduced operational failures.

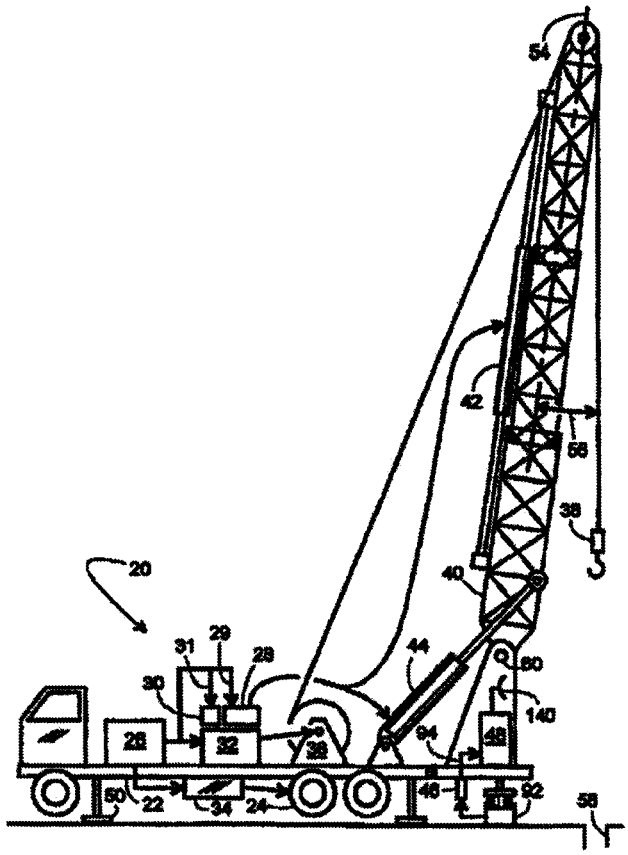

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 24-27 and 31 is confirmed. Claims 1-23, 28-30 and 32-62 were not reexamined.

* * * * *